US005564509A

United States Patent [19]

Dietzen

[11] Patent Number: 5,564,509

[45] Date of Patent: Oct. 15, 1996

[54] OIL AND GAS WELL CUTTINGS DISPOSAL SYSTEM

[76] Inventor: Gary H. Dietzen, P.O. Box 53652, Lafayette, La. 70505-3652

[21] Appl. No.: 416,181

[22] Filed: Apr. 4, 1995

Related U.S. Application Data

[63] Continuation-in-part of Ser. No. 197,727, Feb. 17, 1995, Pat. No. 5,402,857.

[51] Int. Cl.[6] ..... E21B 21/06; B09B 5/00

[52] U.S. Cl. ..... 175/66; 175/206; 175/207

[58] Field of Search ..... 175/66, 206, 207; 134/108

[56] References Cited

U.S. PATENT DOCUMENTS

| | | | |
|---|---|---|---|
| D. 296,027 | 5/1988 | Dietzen | D34/39 |
| D. 337,809 | 7/1993 | Dietzen | D23/202 |
| 1,125,413 | 1/1915 | Van Doren . | |
| 2,803,501 | 8/1957 | Kelly | 302/17 |
| 3,400,819 | 9/1968 | Burdyn | 175/66 |
| 3,433,312 | 3/1969 | Burdyn et al. | 175/66 |
| 3,993,359 | 11/1976 | Sweeney | 302/15 |
| 4,019,641 | 4/1977 | Merz | 214/14 |
| 4,030,558 | 6/1977 | Morris | 175/206 X |
| 4,595,422 | 6/1986 | Hill et al. | 175/206 X |
| 4,793,423 | 12/1988 | Knol | 175/66 |
| 4,878,576 | 11/1989 | Dietzen | 198/494 |
| 4,942,929 | 7/1990 | Malachosky et al. | 175/66 |
| 5,016,717 | 5/1991 | Simons et al. | 175/66 |
| 5,109,933 | 3/1992 | Jackson | 175/66 |
| 5,190,085 | 3/1993 | Dietzen | 141/98 |
| 5,322,393 | 6/1994 | Lundquist | 406/38 |
| 5,341,856 | 8/1994 | Appenzeller | 141/67 |
| 5,344,570 | 9/1994 | McLachlan et al. | 175/66 |

FOREIGN PATENT DOCUMENTS

| | | |
|---|---|---|
| 0005273 | 5/1979 | European Pat. Off. . |
| 2162880 | 2/1986 | United Kingdom . |

OTHER PUBLICATIONS

Max–Vac Rentals, *Vacuum Skid Unit,* Spec Sheet (With Pictures on Back).

Dresser Industries, Inc., Specifications–*Roots Vacuum Boosters* (Frames 406DVJ Thru 1220DVJ), Feb., 1988.

Dresser Industries, Inc., *Roots DVJ Dry Vacuum Whispair® Blowers,* Nov., 1991.

Dresser Industries, Inc., Specifications–*Roots DVJ Whispair® Dry Vacuum Pumps* (Frames 1016J, 1220J and Larger), Dec., 1992.

Chicago Conveyor Corporation, *Pneumatic Conveying Systems and Specialties,* Brochure.

*Primary Examiner*—Frank Tsay

*Attorney, Agent, or Firm*—Pravel, Hewitt, Kimball & Krieger

[57] ABSTRACT

A method of removing drill cuttings from an oil and gas well drilling platform includes the steps of separating the drill cuttings from the well drilling fluid on the drilling platform so that the drilling fluids can be recycled into the well bore during drilling operations. The cuttings are transmitted via gravity flow to a materials trough having an interior defined by sidewalls and a bottom portion. The drill cuttings are suctioned from the bottom portion of the trough interior with a first suction line having an intake portion that is positioned at the materials trough bottom. Drill cuttings are transmitted via the suction line at flow velocities in excess of 100 feet per second to a holding tank that has an access opening. A vacuum is formed within the holding tank interior using a blower that is in fluid communication with the tank interior via a second vacuum line. Liquids and solids flowing in the vacuum lines are separated from the vacuum lines before the liquids and solids can enter the blower. The blower is powered with an electric motor and the tank interior is sealed after being filled with drill cuttings to be disposed of. The tank is configured to be emptied via gravity flow at a remote disposal site by opening the access openings and allowing the cuttings to flow via gravity from the tank interior access openings.

28 Claims, 4 Drawing Sheets

OIL AND GAS WELL CUTTINGS DISPOSAL SYSTEM

CROSS REFERENCE TO RELATED APPLICATIONS

This is a continuation-in-part of U.S. patent application Ser. No. 08/197,727, filed Feb. 17, 1995, which is now U.S. Pat. No. 5,402,857 which is incorporated herein by reference.

BACKGROUND OF THE INVENTION

1. Field of the Invention

The present invention relates to the disposal of oil and gas well cuttings such as are generated during the drilling of an oil and gas well using a drill bit connected to an elongated drill string that is comprised of a number of pipe sections connected together, wherein a fluid drilling mud carries well cuttings from the drill bit through a well annulus and to a solids removal area at the well head for separating well cuttings from the drilling mud. Even more particularly, the present invention relates to an improved well cuttings disposal system that collects oil and gas well cuttings in a transportable tank that is subjected to a vacuum (16–25 mercury) formed with a motor driven blower that moves about 300–1300 cubic feet per minute of air containing cuttings, and in relatively small hoses to generate flow velocities of between about 100–300 feet/sec.

2. General Background

In the drilling of oil and gas wells, a drill bit is used to dig many thousands of feet into the earth s crust. Oil rigs typically employ a derrick that extends above the well drilling platform and which can support joint after joint of drill pipe connected end to end during the drilling operation. As the drill bit is pushed farther and farther into the earth, additional pipe joints are added to the ever lengthening string or drill string. The drill pipe or drill string thus comprises a plurality of joints of pipe, each of which has an internal, longitudinally extending bore for carrying fluid drilling mud from the well drilling platform through the drill string and to a drill bit supported at the lower or distal end of the drill string.

Drilling mud lubricates the drill bit and carries away well cuttings generated by the drill bit as it digs deeper. The cuttings are carried in a return flow stream of drilling mud through the well annulus and back to the well drilling platform at the earth s surface. When the drilling mud reaches the surface, it is contaminated with these small pieces of shale and rock which are known in the industry as well cuttings or drill cuttings.

Well cuttings have in the past been separated from the reusable drilling mud with commercially available separators that are know as shale shakers. Some shale shakers are designed to filter coarse material from the drilling mud while other shale shakers are designed to remove finer particles from the well drilling mud. After separating well cuttings therefrom, the drilling mud is returned to a mud pit where it can be supplemented and/or treated prior to transmission back into the well bore via the drill string and to the drill bit to repeat the process.

The disposal of shale and cuttings is a complex environmental problem. Drill cuttings contain not only the mud product which would contaminate the surrounding environment, but also can contain oil that is particularly hazardous to the environment, especially when drilling in a marine environment.

In the Gulf of Mexico for example, there are hundreds of drilling platforms that drill for oil and gas by drilling into the subsea floor. These drilling platforms can be in many hundreds of feet of water. In such a marine environment, the water is typically crystal clear and filled with marine life that cannot tolerate the disposal of drill cuttings waste such as that containing a combination of shale, drilling mud, oil, and the like. Therefore, there is a need for a simple, yet workable solution to the problem of disposing of oil and gas well cuttings in an offshore marine environment and in other fragile environments where oil and gas well drilling occurs.

Traditional methods of cuttings disposal have been dumping, bucket transport, cumbersome conveyor belts, and washing techniques that require large amounts of water. Adding water creates additional problems of added volume and bulk, messiness, and transport problems. Installing conveyors requires major modification to the rig area and involves many installation hours and very high cost.

SUMMARY OF THE INVENTION

The present invention provides an improved method and apparatus for removing drill cuttings from an oil and gas well drilling platform that uses a drill bit supported with an elongated, hollow drill string. Well drilling fluid (typically referred to as drilling mud) that travels through the drill string to the drill bit during a digging of a well bore. The method first includes the step of separating well drilling fluid from the waste drill cuttings on the drilling platform so that the drilling fluid can be recycled into the well bore during drilling operations. The drill cuttings fall via gravity from solid separators (e.g. shale shakers) into a material trough. At the material trough, cuttings are suctioned with an elongated suction line having an intake portion positioned in the materials trough to intake well cuttings as they accumulate.

The drill cuttings are transmitted via the suction line to a holding tank that has an access opening. A vacuum is formed within the holding tank interior using a blower that is in fluid communication with the tank interior via a second vacuum line.

Liquids (drilling mud residue) and solids (well cuttings) are separated from the vacuum line at the tank before the liquids and solids can enter the blower.

The blower is powered with an electric motor drive, to reach a vacuum of between about sixteen and twenty-five inches of mercury. The vacuum line is sized to generate speeds of between about one hundred and three hundred feet per second.

The tank is sealed after the interior is filled with drill cuttings to be disposed of. The tank is emptied of drill cuttings at a desired remote disposal site by opening the access opening to allow gravity flow of the cuttings from the tank interior via the access opening.

In the preferred embodiment, three suction lines are used including a first line that communicates between the materials trough and the holding tank, a second suction line that extends between the holding tank and a separator skid, and a third suction line that communicates between the separator skid and blower.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
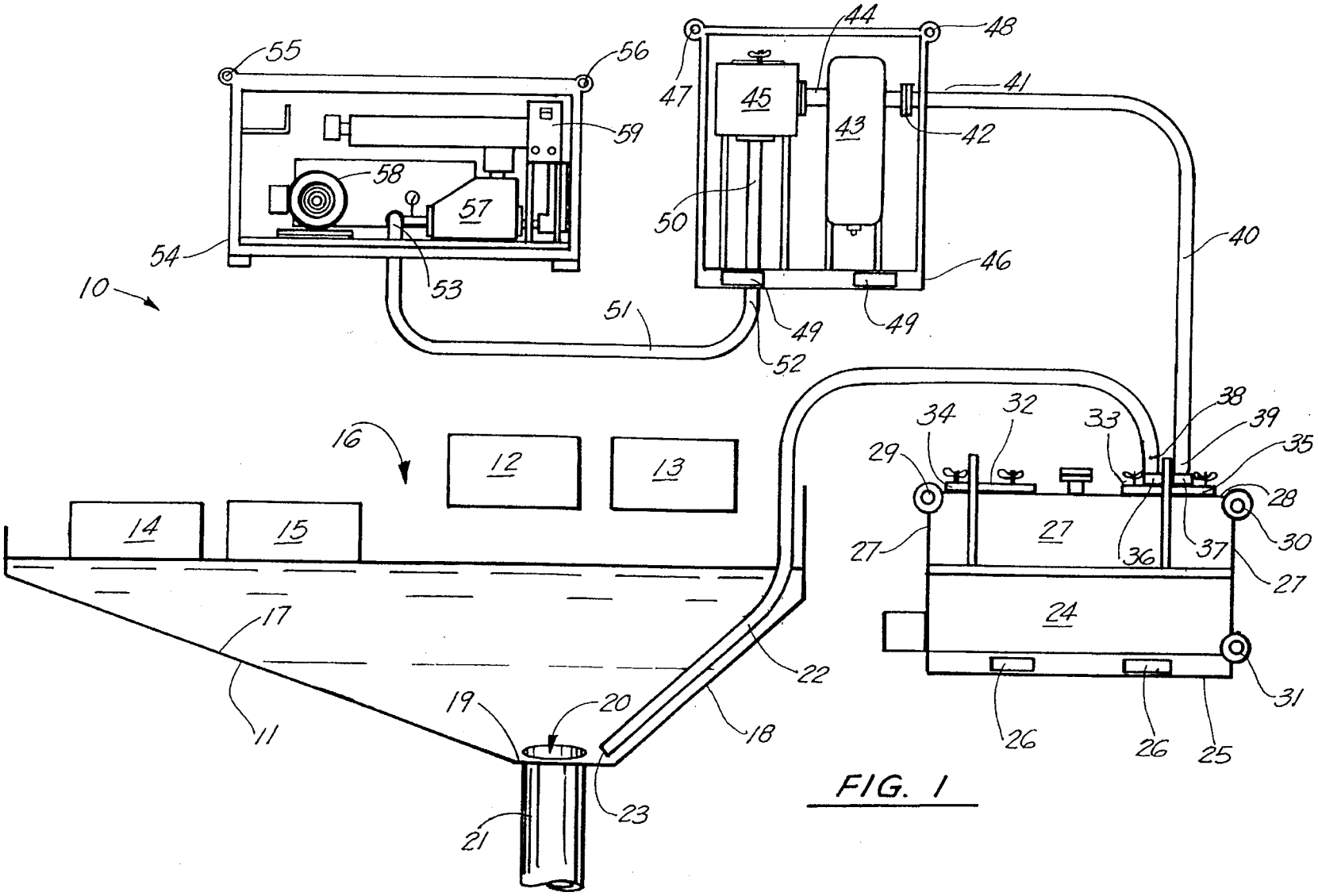
FIG. 1 is a schematic view of the preferred embodiment of the apparatus of the present invention.

In FIG. 1, there can be seen a well cuttings disposal system 10 of the present invention. Well cuttings disposal system 10 is used in combination with a material trough that collects solids falling via gravity from a plurality of solids separator units. Material troughs per second are known in the art, typically as a catch basin for cuttings. The material trough 11 defines an area that is a receptacle for solids containing some residual drilling mud. Cuttings have been collected from the well bore after the drilling mud has been transmitted through the drill string to the drill bit and then back to the surface via the well annulus.

At the material trough, there are a plurality of coarse shakers 12, 13 and a plurality of fine shakers 14, 15. The shakers 12, 13, and 14, 15 are commercially available. Coarse shakers 12, 13 are manufactured under and sold under the mark BRANDT and fine shakers are sold under the mark DERRICK. Shakers 12–15 channel away the desirable drilling mud to a mud pit. The well cuttings fall via gravity into trough 11. It is known in the prior art to channel away drilling mud that is to be recycled, and to allow well cuttings to fall from shale shakers via gravity into a receptacle. Such as been the case on oil and gas well drilling rigs for many years.

Interior 16 of trough 11 catches cuttings that have fallen from shakers 12, 15. The trough 11 thus defines an interior 16 having a plurality of inclined walls 17, 18 that communicate with a trough bottom 19. Walls 17, 18 can be teflon covered to enhance travel of material to bottom 19.

Trough bottom 19 includes a discharge opening 20 that communicates with discharge conduit 21. The opening 20 is typically sealed during operation with a closure plate (not shown).

A first suction line 22 is positioned to communicate with the interior 16 portion of trough 11. First suction line 22 thus provides an inlet 23 end portion and an opposite end portion that communicates with collection tank 24. Tank 24 collects solid material and some liquid (e.g. residual drilling mud on the cuttings) as will be described more fully hereinafter.

Collection tank 24 has a bottom 25, a plurality of four generally rectangular side walls 27, and a generally rectangular top 28. A pair of spaced apart fork lift sockets 26 allow tank 24 to be lifted and transported about the rig floor and to a position adjacent a crane or other lifting device.

A plurality of lifting eyes 29, 31 are provided including eyes 29, 30 on the top of tank 24 and lifting eye 31 on the side thereof near bottom 25.

The lifting eyes 29 and 30 are horizontally positioned at end portions of the tank top 28. This allows the tank to be lifted with a crane, spreader bar, or other lifting means for transferral between a marine vessel such as a work boat and the drilling rig platform. In FIG. 1, the tank 24 is in such a generally horizontal position that is the orientation during use and during transfer between the rig platform and a remote location on shore, for example.

The lifting eyes 30, 31 are used for emptying the tank 24 after it is filled with cuttings to be disposed of. When the tank is to be emptied, a spreader bar and a plurality of lifting lines are used for attachment to lifting eyes 30, 31. This supports the tank in a position that places lifting eye 29 and lifting eye 30 in a vertical line. In this position, the hatch 34 is removed so that the cuttings can be discharged via gravity flow from opening 30 and into a disposal site.

During a suctioning of well cuttings from materials trough 11, the suction line 22 intakes cuttings at inlet 23. These cuttings travel via line 22 to outlet 38 which communicates with coupling 36 of tank 24. Flow takes place from inlet 23 to outlet 38 because a vacuum is formed within the hollow interior of tank 24 after hatches 34, 35 are sealed. The vacuum is produced by using second suction line 40 that communicates via separators 43, 45 with third suction line 51 and blower 57.

Second suction line 41 connects at discharge 39 to coupling 37 of hatch 35. The opposite end of suction line 40 connects at end portion 41 via coupling 42 to fine separator 43. A second fines separator 45 is connected to separator 43 at spoolpiece 44. The two separators 43 and 45 are housed on a structural separator skid 46 that includes lifting eyes 47, 48 and fork lift sockets 49 for transporting the skid 46 in a manner similar to the transport of tank 24 as aforedescribed.

Third suction line 51 connects to effluent line 50 that is the discharge line from separator 45. End portion 52 of third suction line 51 connects to effluent line 50 at a flange, removable connection for example. The three suction lines 22, 40, 51 are preferably between three and six inches in internal diameter, and are coupled with blower 57 generating about 300–1500 CFM of air flow, to generate flow desired velocities of about 100–300 feet per second that desirably move the shale cuttings through suction line 22. The suction lines are preferably flexible hoses of oil resistant PVC or can be Teflon coated rubber. Quick connect fittings are used to connect each suction line at its ends.

End portion 53 of third section line 51 also connects via a flanged coupling, for example, to blower 57. Blower 57 and its motor drive 58 are contained on power skid 54. Power skid 54 also includes a control box 59 for activating and deactivating the motor drive 58 and blower 57. The power skid 54 provides a plurality of lifting eyes 55, 56 to allow the power skid 54 to be transported from a work boat or the like to a well drilling platform using a lifting harness and crane that are typically found on such rigs.

Each of the units including tank 24, separator skid 46, and power skid 54 can be lifted from a work boat or the like using a crane and transported to the rig platform deck which can be for example 100 feet above the water surface in a marine environment.

Figure 2:
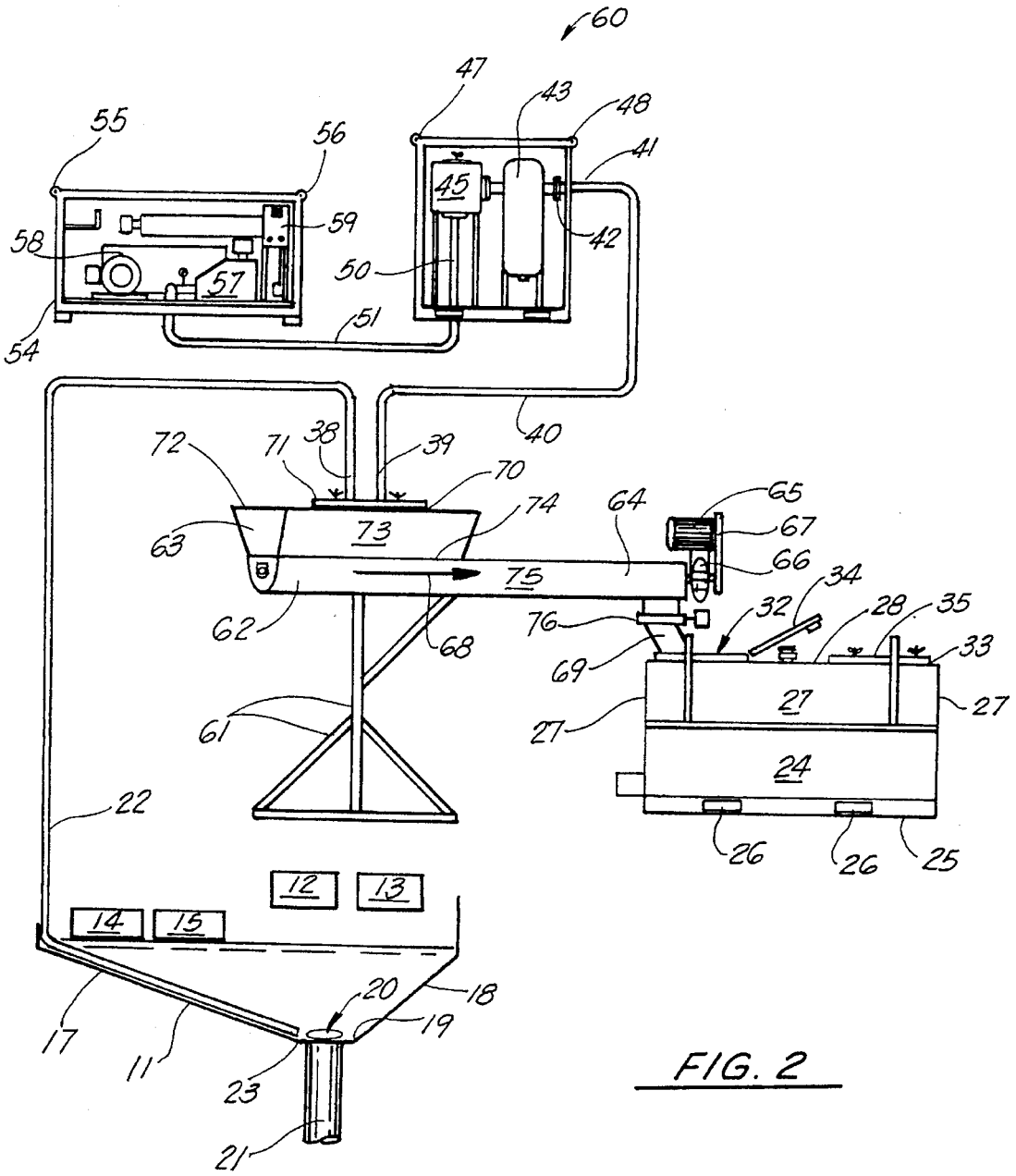
FIG. 2 is a schematic view of an alternate embodiment of the apparatus of the present invention.

In FIG. 2, an alternate embodiment of the apparatus of the present invention is disclosed designated generally by the numeral 60. In FIG. 2, the tank 24 is similarly constructed to that of the preferred embodiment of FIG. 1. However, in FIG. 2, the well cuttings disposal system 60 includes a support 61 that supports a screw conveyor 62 and its associated trough 63. The trough 63 and screw conveyor 62 are sealed at opening 70 in trough 63 using hatch 71. Trough 63 is positioned at an intake end portion of screw conveyor while the opposite end portion of screw conveyor 62 provides a discharged end portion 64 that communicates with discharge shoot 69. Chute 69 empties into opening 32 when hatch 34 is open during use, as shown in FIG. 2.

The screw conveyor 62 is driven by motor drive 65 that can include a reduction gear box 66 for example, and a drive belt 67. Arrow 68 in FIG. 2 shows the flow path of coarse cuttings that are discharged via first suction lines 22 into opening 70 and trough 63. The sidewall and bottom 74 of trough 63 communicate and form a seal with screw conveyor outer wall 75 so that when a vacuum is applied using second suction line 40, cuttings can be suctioned from trough 11 at intake 23 as with the preferred embodiment. The conveyor 62 forcebly pushes the drill cuttings toward discharge end 64. A spring activated door 76 is placed in chute 69. When material backs up above door 76, the door quickly opens under the weight of cuttings in chute 69. Once the cuttings pass door 76, the door shuts to maintain the vacuum inside trough 73, and screw conveyor 62, thus enabling continuous vacuuming.

Figure 3:
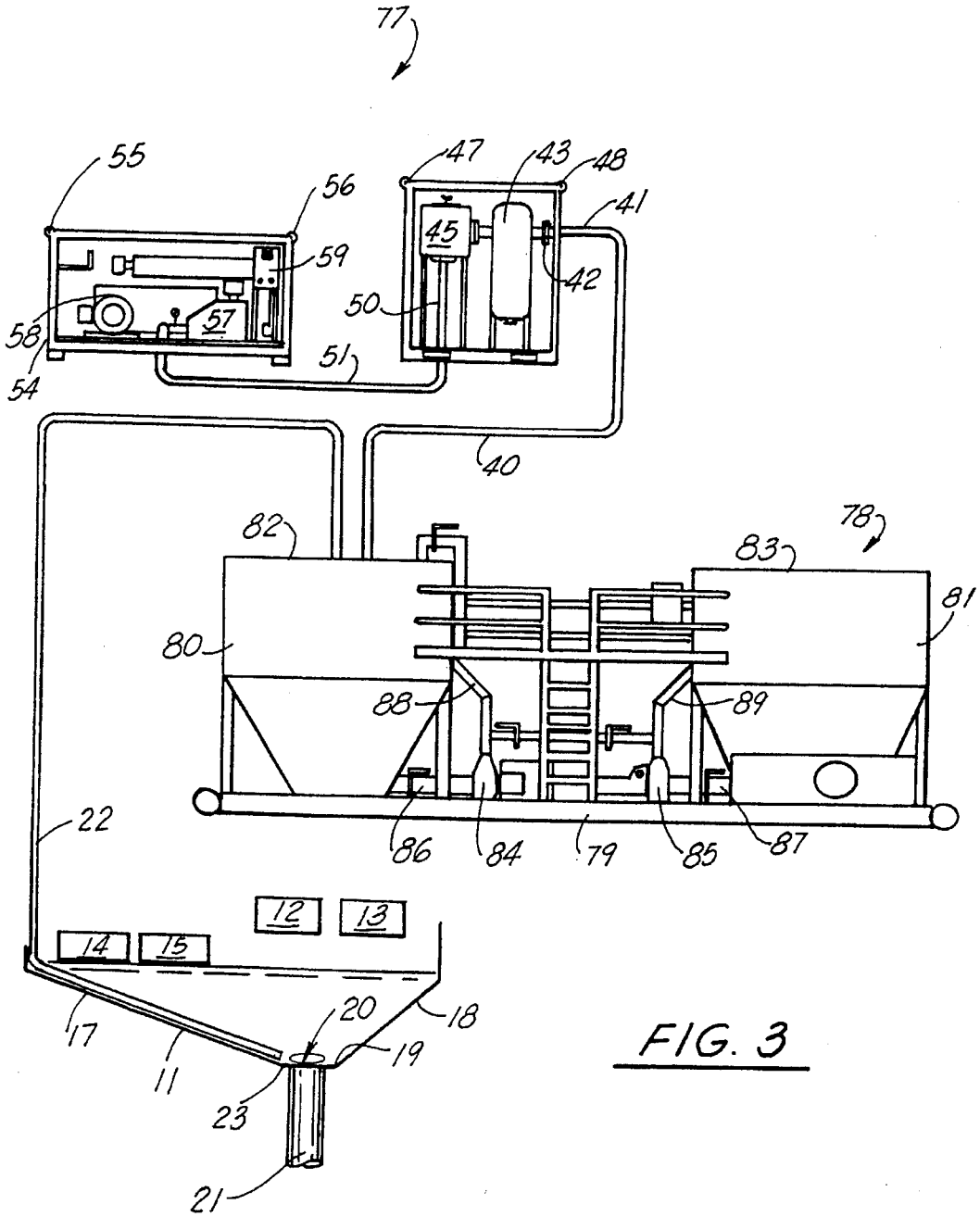
FIG. 3 is a schematic view of a second alternate embodiment of the apparatus of the present invention.

In FIG. 3 there can be seen a second alternate embodiment of the apparatus of the present invention designated generally by the numeral 77. Well disposal cutting system 77 substitutes a slurry unit 78 for collection tank 24 of FIG. 1. Slurry unit 78 has a liftable base frame 79 of welded steel, for example. Upon the frame 79 are positioned a pair of spaced apart vessels 80, 81. Each vessel 80, 81 has a top into which well cuttings can be suctioned in a manner similar to the way in which well cuttings are suctioned into collection tank 24 with the embodiment of FIG. 1. The vessel tops 82, 83 respectively can be provided with openings for connecting the flow lines 22–40 thereto as with the embodiments of FIGS. 1 and 2. The slurry unit 28 provides pumps with impellers (e.g., Mission Magnum fluid centrifugal pump with 75 hp electric motor—5 discharge, 6 suction) for breaking up the cuttings continuously until they form a slurry with a liquid such as water, for example. Pumps 84, 85 have suctioned flow lines 86, 87 respectively and discharge lines 88, 89 respectively. The discharge lines 88, 89 can be seen communicating with the upper end portion of each of the vessels 80, 81 respectively. Likewise, the suction lines 86, 87 communicate with the lower end portion of each of the vessels 80, 81 respectively.

Using the method and apparatus of FIG. 3, a desired volume of cuttings can be suctioned into either one or both of the vessels 80, 81. The pumps 84, 85 are equipped with impellers that can chop up the cuttings into even finer pieces. For example, the pump impellers can have carbide tips that are effective in chopping up and pulverizing the cuttings until a slurry is formed. Each pump 84, 85 respectively continuously recirculates the slurry of cuttings and water between the pump 84, 85 and its respective vessel 80, 81 until a thick vicuous slurry is created. A triplex pump (e.g., Gardner Denver) and piping (not shown) can then be used for transmitting the slurried cuttings from the respective vessels 80, 81 downhole, into the well annulus, usually between 2000–5000 for example, into a porous zone such as a sand zone. In this fashion, the cuttings are disposed of by deep well disposal at the drill site rather than transporting the cuttings to a remote cite such as onshore in the case of a marine based platform.

Figure 4:
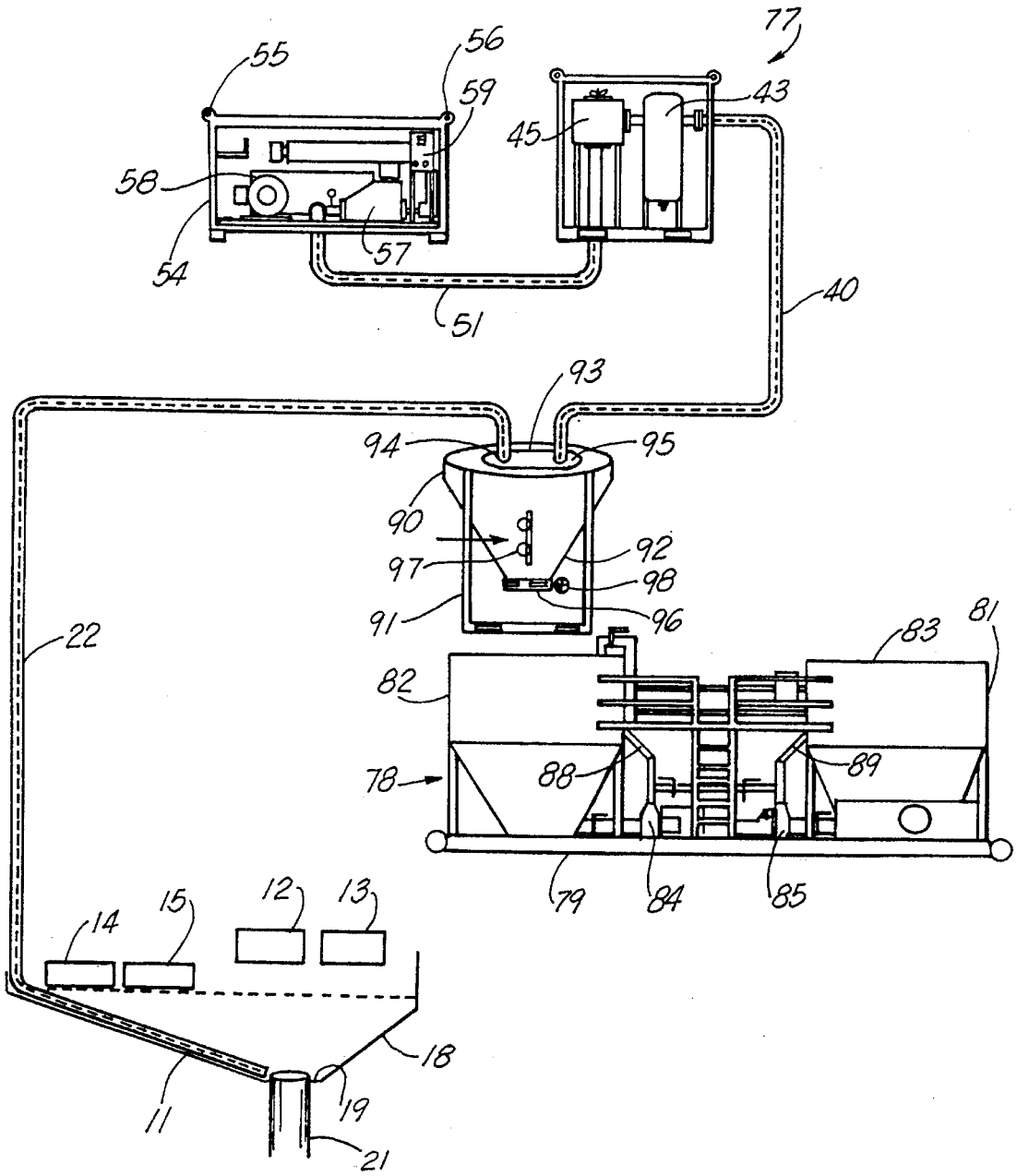
FIG. 4 is a schematic view of the second alternate embodiment of the apparatus of the present invention illustrating the use of a hopper tank in combination with the slurry unit.

In FIG. 4, a hopper tank 90 is shown in combination with the slurry unit 78. Hopper 90 is an optional unit that can be used to receive cuttings from first suction line 22 and to collect the cuttings for batch discharge into slurry unit 78 at intervals. As with the embodiment of FIG. 1, the hopper tank 90 provides a rectangular or circular lid 93 with openings 94, 95 that respectively communicate with vacuum lines 22 and 40.

Hopper tank 90 is preferably supported with a structural liftable frame 91. The tank 90 has a conical wall 92. The upper end portion of tank 90 provides the circular lid 93 while the lower end portion of tank 90 has a discharge outlet 96 controlled by valve 98. Air vibrators 97 can be attached to the conical wall 92 for insuring a complete and smooth discharge of cuttings from within the interior of the hollow hopper tank 90.

The following table lists the parts numbers and parts descriptions as used herein and in the drawings attached hereto.

PARTS LIST

| Part Number | Description |
|---|---|
| 10 | well cuttings disposal system |
| 11 | material trough |
| 12 | coarse shaker |
| 13 | coarse shaker |
| 14 | fine shaker |
| 15 | fine shaker |
| 16 | reservoir |
| 17 | inclined wall |
| 18 | inclined wall |
| 19 | trough bottom |
| 20 | discharge opening |
| 21 | conduit |
| 22 | first suction line |
| 23 | inlet |
| 24 | collection tank |
| 25 | bottom |
| 26 | fork lift socket |
| 27 | side wall |
| 28 | top |
| 29 | lifting eye |
| 30 | lifting eye |
| 31 | lifting eye |
| 32 | opening |
| 33 | opening |
| 34 | hatch |
| 35 | hatch |
| 36 | coupling |
| 37 | coupling |
| 38 | outlet |
| 39 | discharge |
| 40 | second suction line |
| 41 | end |
| 42 | coupling |
| 43 | separator |
| 44 | spoolpiece |
| 45 | separator |
| 46 | separator skid |
| 47 | lifting eye |
| 48 | lifting eye |
| 49 | fork lift socket |
| 50 | effluent line |
| 51 | third suction line |
| 52 | end |
| 53 | end |
| 54 | power skid |
| 55 | lifting eye |
| 56 | lifting eye |
| 57 | blower |
| 58 | motor drive |
| 59 | control box |
| 60 | well cuttings disposal system |
| 61 | support |
| 62 | screw conveyor |
| 63 | trough |
| 64 | discharge end portion |
| 65 | motor drive |
| 66 | gearbox |
| 67 | drive belt |
| 68 | arrow |

-continued

PARTS LIST

| Part Number | Description |
|---|---|
| 69 | discharge chute |
| 70 | opening |
| 71 | hatch |
| 72 | top |
| 73 | side wall |
| 74 | bottom |
| 75 | screw conveyor outer wall |
| 76 | spring loaded door |
| 77 | well cuttings disposal unit |
| 78 | slurry unit |
| 79 | frame |
| 80 | vessel |
| 81 | vessel |
| 82 | top |
| 83 | top |
| 84 | pump |
| 85 | pump |
| 86 | flow line |
| 87 | flow line |
| 88 | flow line |
| 89 | flow line |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings via gravity flow to a materials trough having an interior defined by side walls and a bottom portion;

c) suctioning the separated drill cuttings with a first vacuum "suction" line having an intake end portion that is positioned at the materials trough bottom portion;

d) transmitting the drill cuttings via the first vacuum "suction" line to a holding tank that has at least one access opening for communicating with the tank interior;

e) forming a vacuum within the holding tank interior with a blower that is in fluid communication with the tank interior via a second vacuum line;

f) separating liquids and solids from the first and second vacuum lines before said liquids and solids can enter the blower;

g) powering the blower with an electric motor;

h) forming a slurry of the drill cuttings; and i) emptying the tank of drill cuttings by pumping the slurry of cuttings into the well bore.

2. The method of claim 1 wherein in step "d", the holding tank access opening is covered with a hatch that has inlet and outlet fittings connectable respectively to the first and second vacuum lines.

3. The method of claim 1 wherein the flow velocity in the first suction line is about one hundred to three hundred (100–300) feet per second.

4. The method of claim 1 further comprising the step of transporting the holding tank to and from the drilling platform using a lifting device that attaches to lifting eyes on the outside surface of the holding tank.

5. The method of claim 1 wherein in step "f", liquids and solids are separated from the first suction line at the holding tank and liquids and solids are separated from the second vacuum line at a separator that is positioned in fluid communication with the second vacuum line upstream of the blower.

6. The method of claim 1 wherein in step "g", the blower generates fluid flow in the first and second vacuum lines of between about three hundred and fifteen hundred (300–1500) cubic feet per minute.

7. The method of claim 1 wherein the vacuum formed within the tank in step "e" is between about sixteen and twenty-five (16–25) inches of mercury.

8. An oil well drill cuttings disposal apparatus for use at an oil well drilling site, comprising:

a) a collection tank for collecting drill cuttings to be disposed of, said tank having an interior and an access opening that allows material to be discharged from the tank when the tank is to be emptied;

b) means on said tank for transporting said tank to and from the oil well drilling site;

c) means for sealing said tank after the tank interior is filled with drill cuttings to be disposed of;

d) a first suction line for transmitting cuttings from the drill site at the opening to the tank interior;

e) power means for forming a vacuum within the tank interior and comprising a blower and an electric motor drive for powering said blower;

f) a second suction line for communicating between the tank interior and the power means;

g) the assembly of the first and second suction lines and tank including separator means for preventing the travel of solid and liquid matter from the tank interior to the blower; and h) means for discharging drill cuttings from the tank via the access opening.

9. The apparatus of claim 8 wherein the suction lines are flexible hoses.

10. The apparatus of claim 8 further comprising a screw conveyor for pushing well cuttings from the first suction line to the tank interior.

11. The apparatus of claim 8 wherein the conveyor continuously feeds cuttings to the tank interior so that the first suction line can continuously intake cuttings.

12. The apparatus of claim 8 wherein the separator means includes a separator positioned between the power means and the tank in the second suction line.

13. The apparatus of claim 8 wherein the tank and power means are separate transportable units.

14. The apparatus of claim 12 wherein the separator and power means are each mounted on separate transportable frames.

15. The apparatus of claim 1 wherein the tank is a slurry forming unit.

16. A method of removing drill cuttings from an oil and gas well drilling platform that uses a drill bit supported with a drill string and a well drilling fluid during a digging of a well bore, comprising the steps of:

a) separating drill cuttings from the majority of the well drilling fluid on the drilling platform;

b) transmitting the separated cuttings to a receptacle;

c) suctioning the separated drill cuttings from the receptacle with a first vacuum line having an intake end portion;

d) transmitting the drill cuttings via the first vacuum line to a transportable, movable holding tank that has a tank interior and at least one access opening for communicating with the tank interior;

e) forming a vacuum within the holding tank interior with a blower that is in fluid communication with the tank interior via a second vacuum line;

f) separating drill cuttings that travel in the first vacuum line to the tank before said drill cuttings can enter the blower by accumulating the drill cuttings in the tank interior until the tank is filled with a desired volume;

g) powering the blower with an electric motor in steps "e" and "f";

h) transporting the filled tank to a remote location; and i) emptying the tank interior of drill cuttings at a remote location.

17. The method of claim 16 wherein in step "d", the holding tank access opening is covered with a closure hatch that has an inlet fitting connectable to the first vacuum line and an outlet fitting connectable to the second vacuum line.

18. The method of claim 16 wherein the flow velocity in the first vacuum line is about one hundred to three hundred (100–300) feet per second.

19. The method of claim 16 further comprising the step of transporting the holding tank to and from the drilling platform using a lifting device that attaches to lifting eyes on the outside surface of the holding tank.

20. The method of claim 16 wherein in step "f" at least some of the drill cuttings are separated from the first vacuum line at the holding tank and other drill cuttings are separated from the second vacuum line at a separator that is positioned in fluid communication with the second vacuum line upstream of the blower.

21. The method of claim 16 wherein in step "g", the blower generates fluid flow in the vacuum lines of between about three hundred and fifteen hundred (300–1500) cubic feet per minute.

22. The method of claim 16 wherein the vacuum formed within the tank in step "e" is between about sixteen and twenty-five (16–25) inches of mercury.

23. An oil well drill cuttings disposal apparatus for use at an oil well drilling site comprising:

a) a collection tank for collecting drill cuttings to be disposed of, said tank having an interior and an access opening that allows material to be discharged from the tank when the tank is to be emptied;

b) lifting means on said tank for transporting said tank to and from the oil well drilling site;

c) closure means for sealing said tank access opening after the tank interior is filled with drill cuttings to be disposed of;

d) a first suction line for transmitting cuttings from the drilling site to the tank interior via the access opening;

e) power means for forming a vacuum within the tank interior and comprising a blower and an electric motor drive for powering said blower;

f) a second suction line for communicating between the tank interior at the access opening and the power means;

g) a separator positioned in a flow path defined by the combination of first suction line, tank and second suction line for preventing the travel of any drill cutting or other extraneous solid or liquid matter to the blower;

h) the tank access opening being sized and shaped for enabling the discharge of drill cuttings from the tank via the access opening; and i) a closure plate having a pair of plate openings therein for sealing the access opening, each suction "vacuum" line communicating with the tank via the plate openings.

24. The apparatus of claim 23 wherein the suction lines are flexible hoses.

25. The apparatus of claim 23 further comprising a screw conveyor for pushing well cuttings from the first suction line to the tank interior.

26. The apparatus of claim 25 wherein the conveyor continuously feeds cuttings to the tank interior so that the first suction line can continuously intake cuttings.

27. The apparatus of claim 23 wherein the tank and power means are separate transportable units.

28. The apparatus of claim 27 wherein the separator and power means are each mounted on separate transportable frames.

* * * * *